US006003977A

United States Patent [19]

Weber et al.

[11] Patent Number: 6,003,977

[45] Date of Patent: Dec. 21, 1999

[54] BUBBLE VALVING FOR INK-JET PRINTHEADS

[75] Inventors: Timothy L. Weber; David J. Waller, both of Corvallis, Oreg.; Kenneth E. Trueba, Sant Cugat del Valles, Spain; David Thomas, Corvallis, Oreg.

[73] Assignee: Hewlett-Packard Company, Palo Alto, Calif.

[21] Appl. No.: 08/692,905

[22] Filed: Jul. 30, 1996

Related U.S. Application Data

[63] Continuation-in-part of application No. 08/597,746, Feb. 7, 1996, abandoned.

[51] Int. Cl.[6] ..... B41J 2/05

[52] U.S. Cl. ..... 347/63; 347/65

[58] Field of Search ..... 347/63, 65, 56, 347/54, 20, 1, 22, 87

[56] References Cited

U.S. PATENT DOCUMENTS

| | | | |
|---|---|---|---|
| 3,973,106 | 8/1976 | Ura | 219/216 |
| 4,463,359 | 7/1984 | Ayata et al. | 347/56 |
| 4,513,298 | 4/1985 | Scheu | 346/140 R |
| 4,528,574 | 7/1985 | Boyden | 346/140 R |
| 4,683,481 | 7/1987 | Johnson | 346/140 R |
| 4,794,411 | 12/1988 | Taub et al. | 346/140 R |
| 4,847,630 | 7/1989 | Bhaskar et al. | 346/1.1 |
| 4,882,595 | 11/1989 | Trueba et al. | 346/140 R |
| 4,894,664 | 1/1990 | Tsung Pan | 346/1.1 |
| 4,896,171 | 1/1990 | Ito | 347/63 |
| 4,947,193 | 8/1990 | Deshpande | 346/140 R |
| 5,016,024 | 5/1991 | Lam et al. | 346/1.1 |
| 5,053,787 | 10/1991 | Teresawa et al. | 347/22 |
| 5,159,353 | 10/1992 | Fasen et al. | 346/140 R |
| 5,291,226 | 3/1994 | Schantz et al. | 346/140 R |
| 5,305,015 | 4/1994 | Schantz et al. | 346/1.1 |
| 5,305,018 | 4/1994 | Schantz et al. | 346/1.1 |
| 5,333,007 | 7/1994 | Kneezel et al. | 347/20 |
| 5,389,957 | 2/1995 | Kimura et al. | 347/20 |
| 5,408,738 | 4/1995 | Schantz et al. | 79/611 |
| 5,442,384 | 8/1995 | Schantz et al. | 347/20 |
| 5,450,113 | 9/1995 | Childers et al. | 347/87 |
| 5,453,769 | 9/1995 | Schantz et al. | 347/63 |
| 5,463,413 | 10/1995 | Ho et al. | 347/65 |

FOREIGN PATENT DOCUMENTS

| | | | |
|---|---|---|---|
| 403231856 | 10/1991 | Japan | 347/65 |

OTHER PUBLICATIONS

James P. Shields, "Thermal Inkjet Review, or How Do Dots Get from the Pen to the Page?" in *Hewlett–Packard Journal*, p. 67 (Aug. 1992).

*Primary Examiner*—Benjamin R. Fuller
*Assistant Examiner*—Sydney O. Johnson, Jr.

[57] ABSTRACT

The configuration of an ink inlet through which flows ink into a chamber for expulsion from the chamber by a thermal process is such that a vapor bubble generated by the thermal process to eject ink from the chamber expands to simultaneously occlude the inlet, thereby to separate the ink within the chamber from ink within a channel that is in fluid communication with the inlet. The separation eliminates a liquid path between the chamber and the channel so that substantially no ink is blown back into the channel as the bubble expands, thereby improving the thermal efficiency of the process.

14 Claims, 5 Drawing Sheets

BUBBLE VALVING FOR INK-JET PRINTHEADS

This application is a continuation-in-part of application Ser. No. 08/597,746 now abandoned, hereby incorporated by reference.

FIELD OF THE INVENTION

The present invention generally relates to the control of fluid flow within an ink-jet printhead as ink droplets are ejected from the printhead.

BACKGROUND AND SUMMARY OF THE INVENTION

An ink-jet printer includes a pen in which small droplets of ink are formed and ejected toward a printing medium. Such pens include a printhead having an orifice member or plate that has several very small orifices through which the ink droplets are ejected. Adjacent to the orifices are ink chambers, where ink resides prior to ejection through the orifice. Ink is delivered to the ink chambers through ink channels that are in fluid communication with an ink supply. The ink supply may be, for example, contained in a reservoir portion of the pen.

Ejection of an ink droplet through an orifice may be accomplished by quickly heating a volume of ink within the adjacent ink chamber. This thermal process causes ink within the chamber to superheat and form a vapor bubble. Formation of thermal ink-jet vapor bubble is known as nucleation. The rapid expansion of the bubble forces a drop of ink through the orifice. This process is called "firing." The ink in the chamber is typically heated with a resistor that is aligned with the orifice.

Once the ink is ejected, the ink chamber is refilled by capillary force with ink from the ink channel, thus readying the system for firing another droplet.

As ink rushes in to refill an empty chamber, the inertia of the moving ink causes some of the ink to bulge out of the orifice. Because ink within the pen is generally kept at a slightly positive back pressure (that is, a pressure slightly lower than ambient), the bulging portion of the ink immediately recoils into the ink chamber. This reciprocating motion diminishes over a few cycles and eventually stops or damps out.

If a droplet is fired when the ink is bulging out of the orifice, the ejected droplet will be large and dumbbell shaped, and slow moving. Conversely, if the droplet is ejected when ink is recoiling from the orifice, the ejected droplet will be small and spear shaped, and move undesirably fast. Between these two extremes, as the chamber ink motion damps out, well-formed drops are produced for optimum print quality. Thus, print speed (that is, the rate at which droplets are ejected) must be sufficiently slow to allow the motion of the chamber to damp out between each droplet firing. The time period required for the ink motion to damp sufficiently may be referred to as the damping interval.

To lessen the print speed reduction attributable to the damping interval, ink chamber and ink channel geometry may be optimized. Specifically, ink channel length and area may be constructed to restrict the ink flow rate into and out of the chamber, thereby to reduce the reciprocating motion of chamber refill ink (hence, lessen the damping interval). In the past, ink channels have been relatively long with respect to the area, hence the length of the channel is a necessarily important consideration in optimizing damping characteristics of the channel.

Prior ink-jet printheads are also susceptible to ink "blowback" during droplet ejection. Blowback results when some ink in the chamber is forced back into the adjacent part of the channel upon firing. Blowback occurs because the ink in the chamber is not separated from the ink in the channel. Accordingly, upon firing, a large portion of ink affected by the expanding bubble within the chamber is blown back into the channel instead of out the orifice. Blowback increases the amount of energy necessary for ejection of droplets from the chamber ("turn on energy" or TOE) because only a portion of the entire volume of ink in the chamber is actually ejected. A higher TOE results in excessive printhead heating.

Excessive printhead heating also generates bubbles from air dissolved in the ink and causes prenucleation of the ink vapor bubble. Air bubbles within the ink and prenucleation of the vapor bubble result in a poor ink droplet formation and, thus, poor print quality.

Components of the printhead in the vicinity of the vapor bubble are susceptible to damage from cavitation as the vapor bubble collapses between firing intervals. Particularly susceptible to damage from cavitation is the resistor. A thin protective passivation layer is typically applied over the resistor. The application of a passivation layer over the resistor, however, increases the TOE necessary for ejecting droplets. Put another way, the trade-off in efforts to reduce TOE by thinning the passivation layer is reduction in the protection against cavitation damage of the resistor.

The present invention provides a printhead construction that situates an ink inlet contiguous with the camber and immediately adjacent to the resistor in each chamber of the printhead. The ink inlet defines the path through which ink passes from the ink channel and into the chamber. The inlet is sized and located so that as the vapor bubble expands to fire ink from a chamber, the bubble simultaneously moves into the inlet to separate the ink within the chamber from the ink within the channel, thereby occluding any liquid pathway between the chamber and channel as ink is ejected from the orifice. This occlusion of a liquid pathway between the chamber and the channel during firing minimizes blowback. In a sense, therefore, the vapor bubble acts as a valve as it expands to occlude the inlet, hence temporarily stopping ink flow out of the chamber (blowback) during the firing process.

The blowback resistance attributable to this bubble valving raises the system thermal efficiency, lowering TOE. A lower TOE reduces printhead heating. Reducing printhead heating helps maintain a steady operating temperature, which provides uniform print quality.

As another aspect of this invention, the flow length of the inlet, which is the distance between the ink chamber and ink channel through the inlet, is relatively short. Moreover, the volume of ink in the ink channel is substantially greater than that of the ink inlet. As a result, an amount of damping of the ink flow into the chamber may be optimized by consideration of only the area of the inlet.

As another aspect of the present invention, the inlet is arranged so that the ink flows into the chamber along a flow path that, in preferred embodiments, is substantially parallel to the central axis of the orifice, along which axis ink droplets are expelled from the chamber. As a result, the flow of the ink to refill the chamber, which flow commences as the vapor bubble begins to collapse, provides momentum for lifting the collapsing bubble from the resistor so that the eventual collapse point of the bubble is displaced from the resistor, thereby minimizing the damaging effects of cavitation on the resistor that would otherwise occur were the vapor bubble to collapse substantially on the surface of the resistor.

DESCRIPTION OF PREFERRED EMBODIMENTS

Figure 1:
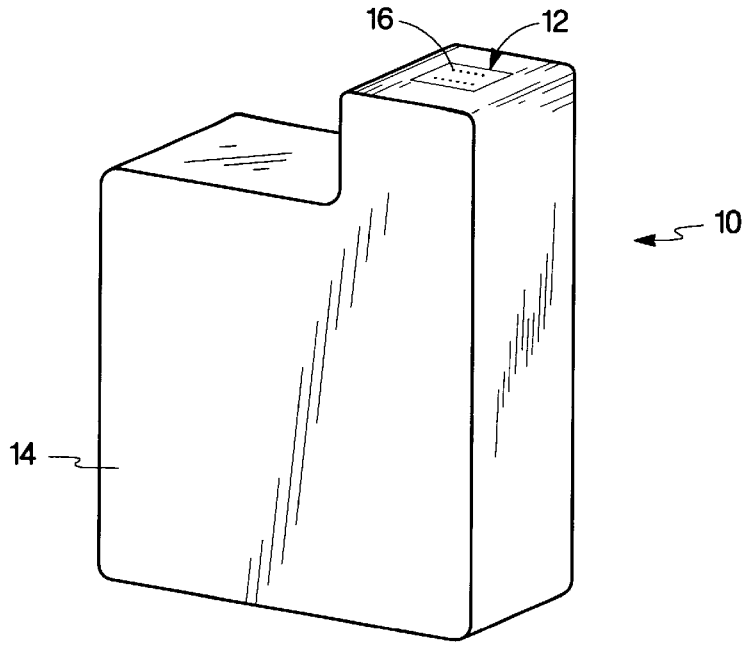
FIG. 1 is a perspective view of an ink-jet pen that incorporates a printhead that is configured and operated for carrying out the bubble valving of the present invention.

FIG. 1 depicts an ink jet pen 10 that incorporates a printhead 12 that is configured and arranged for carrying out the present invention. A preferred embodiment of the pen 10 includes a pen body 14 that defines an internal reservoir for holding a supply of ink. The ink is ejected from the printhead through a plurality of orifices 16 that extend through the exterior of the printhead 12, as shown in FIG. 1.

Figure 2:
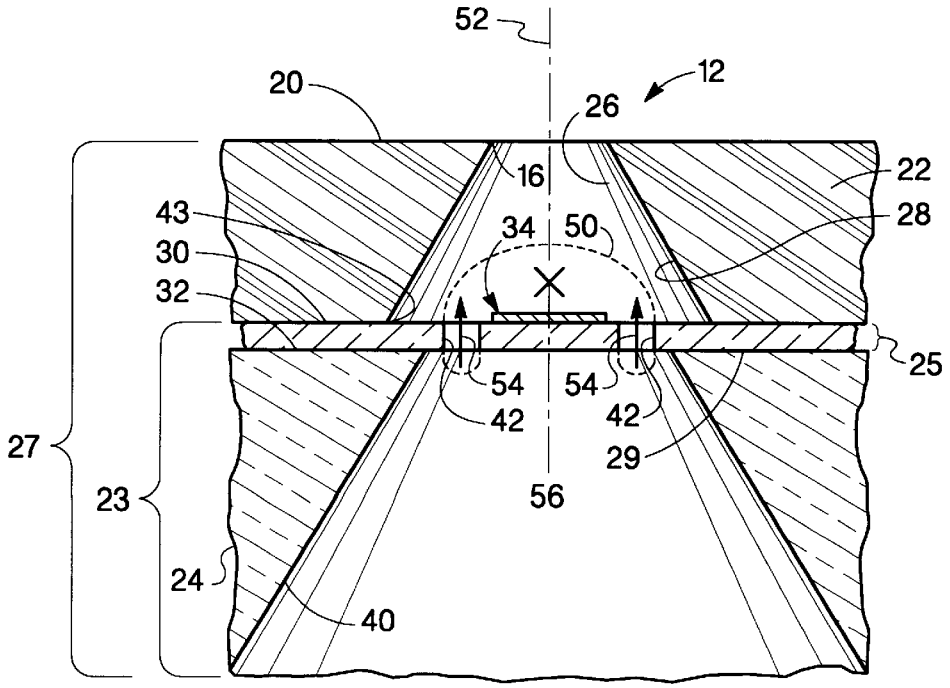
FIG. 2 is an enlarged cross-sectional view of the printhead of FIG. 1 taken across one of a plurality of ink chambers.

FIG. 2 is a greatly enlarged cross-sectional view taken through the printhead and through one of the orifices 16. In FIG. 2, it can be seen that the orifice 16 is formed in the outer surface 20 of an orifice member or plate 22. The orifice plate 22 is attached to a substrate 23. The substrate comprises a silicon base 24 and a support layer 25 as described more fully below. The orifice plate 22, silicone base 24 and support layer 25 comprise a chamber member 27.

The orifice 16 is an opening through the plate 22 of an ink chamber 26 that is formed in the orifice plate 22. The diameter of the of the orifice 16 may be, for example, about 12 to 16 $\mu$m.

In FIG. 2, the chamber 26 is shown with an upwardly tapered sidewall 28, thereby defining a generally frustrum-shaped chamber, the bottom of which is substantially defined by the upper surface 30 of the substrate 23.

It is contemplated that any of a number of ink chamber shapes will suffice, although the volume of the chamber will generally decrease in the direction toward the orifice 16. In the embodiment of FIG. 2, the orifice plate 22 may be formed using a spin-on or laminated polymer. The polymer may be purchased commercially under the trademark CYCLOTENE from Dow Chemical, having a thickness of about 10 to 30 $\mu$m. Any other suitable polymer film may be used, such as polyamide, polymethylmethacrylate, polycarbonate, polyester, polyamide, polyethylene-terephthalate or mixtures thereof. Alternatively, the orifice may be formed of a gold-plated nickel member manufactured by electrodeposition techniques.

The upper surface 32 of the silicon base 24 is coated with a support layer 25. The support layer 25 is formed of silicon dioxide, silicon nitride, silicon carbide, tantalum, polysilicon glass or other functionally equivalent material having different etchant sensitivity than the silicon base 24 of the substrate.

After the support layer 25 is applied, two ink inlets 42 are formed to extend through that layer. In a preferred embodiment, the upper surface 30 of the support layer is patterned and etched to form the inlets 42, before the orifice plate 22 is attached to the substrate 23, and before a channel 40 is etched into the base 24 as described below.

A thin-film resistor 34 is attached to the upper surface 30 of the substrate. Preferably, the resistor is applied after the inlets 42 are formed, but before the orifice plate 22 is attached to the substrate. The resistor may be about 12 $\mu$m long by 12 $\mu$m wide (see FIG. 3). A very thin (about 0.5 $\mu$m) passivation layer (not shown) is deposited on the resistor to provide protection from damage by cavitation. The overall thickness of the support layer, resistor and passivation layer is about 3 $\mu$m.

The resistor 34 is located immediately adjacent to the inlets 42. The resistor 34 acts as an ohmic heater when selectively energized by a voltage pulse applied to it. In this regard, each resistor 34 contacts at opposing sides of the resistor a conductive trace 36. The traces are deposited on the substrate 23 and are electrically connected to the printer microprocessor for conducting the voltage pulses. The conductive traces 36 appear in FIG. 3.

The preferred orifice plate 22 is laid over the substrate 23 on the upper surface 30 of the support layer 25. In this regard, the plate 22 can be laminated, spun on while in liquid form, grown or deposited in place, or plated in place. The plate adheres to the support layer 25.

The resistor 34 is selectively heated or driven by the microprocessor to generate a vapor bubble 50 (shown in dashed lines in FIG. 2) within the ink-filled chamber 26. Ink ejected from the chamber as a consequence of the expanding bubble 50 travels through the central axis 52 of the orifice.

An ink channel 40 is formed in the base 24 of the substrate 23 to be in fluid communication with the inlets 42. Preferably, the channel 40 is etched by anisotropic etching from the lower side of the base 24 up to the underside 29 of the support layer 25.

In accordance with the present invention, ink present in the reservoir of the pen body 14 flows by capillary force through each channel 40 and through the inlets 42 to fill the ink chamber 26. In this regard, the channel 40 has a significantly larger volume than the ink inlets 42. The channel may be oriented to provide ink to more than one chamber 26. Each of the channels may extend to connect with an even larger slot (not shown) cut in the substrate base 24 and in direct fluid communication with the pen reservoir. The base 24 of the substrate is bonded to the pen body surface, which surface defines the boundary of the channel.

All of the ink entering the chamber 26 is conducted through the inlets 42. In this regard, the lower end 43 of the chamber 26 completely encircles the inlets 42 and resistor 34.

The inlets 42, as mentioned, are located to be immediately adjacent to the resistor 34 and are sized so that, upon firing, the expanded bubble 50 occludes the inlets 42 and prevents ink within the chamber 26 from being blown back into the channel 40.

Specifically, the inlets 42 are contiguous with (not significantly spaced from) the chamber 26 and are located so that the junction of the inlet 42 and the chamber 26 is very near the resistor 34. In a preferred embodiment, each inlet is spaced from the resistor by no more than 25% of the resistor member length.

Moreover, the cross-sectional area of the inlet at the junction of the inlet and the chamber 26 is sized to be sufficiently small to ensure that the expanding bubble 50 is able to cover, hence occlude, the inlet area. Such occlusion is accomplished by the bubble 50 when the bubble moves into the inlets 42 and thereby eliminates any liquid-ink pathway between the chamber 26 and the channel 40. As noted earlier, elimination of this pathway prevents the ink within the chamber 26 from being blown back into the channel 40 as the bubble expands.

The elimination of the liquid pathway is best achieved when the bubble 50 completely penetrates the inlets 42 and expands slightly into the volume of the channel 40, as shown by the dashed lines in FIG. 2. In a preferred embodiment, the total area of the inlets should be less than about 120% of the area of the resistor.

It is noteworthy here that, although in the just described preferred embodiment two inlets 42 are depicted, it will be appreciated that fewer or more inlets may be employed while still meeting the discussed relationship of the spacing from the resistor and relative area of inlets and resistor.

Occlusion of the inlet(s) by the expanded vapor bubble may occur with printhead configurations unlike those just described in connection with a preferred embodiment. In this regard, the distance of the inlet from the resistor, or heating member, and the cross-sectional area of the inlet may be greater or less than that specified above, depending upon certain variables. Such variables include ink viscosity and related thermodynamic properties, resistor heat energy per unit of resistor area, and surface energy of the material along which the ink and vapor move.

Also affecting bubble formation or nucleation are the thickness of the passivation layers relative to that of the resistor and the associated thermal conductivity of those components. In the preferred embodiment, the resistor energy density is about 4 $nJ/\mu m^2$, and the viscosity of the ink is about 3 cp, having a boiling point of about 100° C.

With reference to FIG. 2, it will be appreciated that the flow of ink through the inlets 42 generally follows a somewhat linear path indicated as arrow 54 in that figure. In this embodiment, the flow path 54 is generally away from the resistor 34 and toward the orifice 16. More particularly, the flow path 54 is generally parallel to the central axis 52 of the orifice 16.

As a consequence of this orientation of the inlets 42 (hence the orientation of the flow paths 54) ink flowing into the chamber 26 during refill provides flow momentum for lifting the collapsing bubble 50 so that the bubble finally collapses at a location (shown as the "X" 56 in FIG. 2) that is displaced from the surface of the resistor 34. As noted earlier, displacement of the final collapse point to the bubble substantially minimizes the damaging effects of cavitation that would otherwise occur if the bubble were to collapse very near the surface of the resistor.

Figure 3:
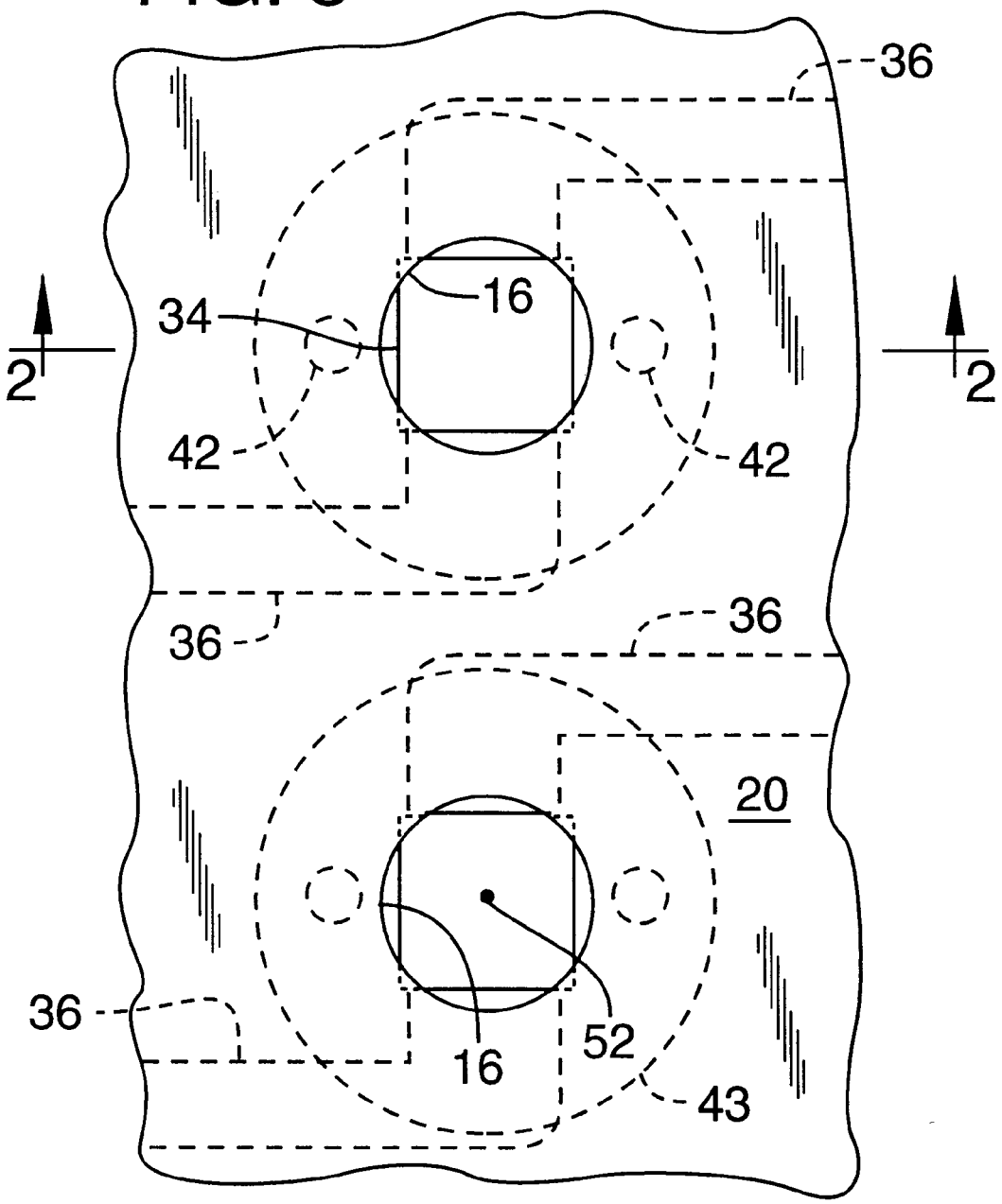
FIG. 3 is an enlarged top view of the pen showing a portion of a printhead, including two orifices that each have an associated ink chamber.
Figure 4:
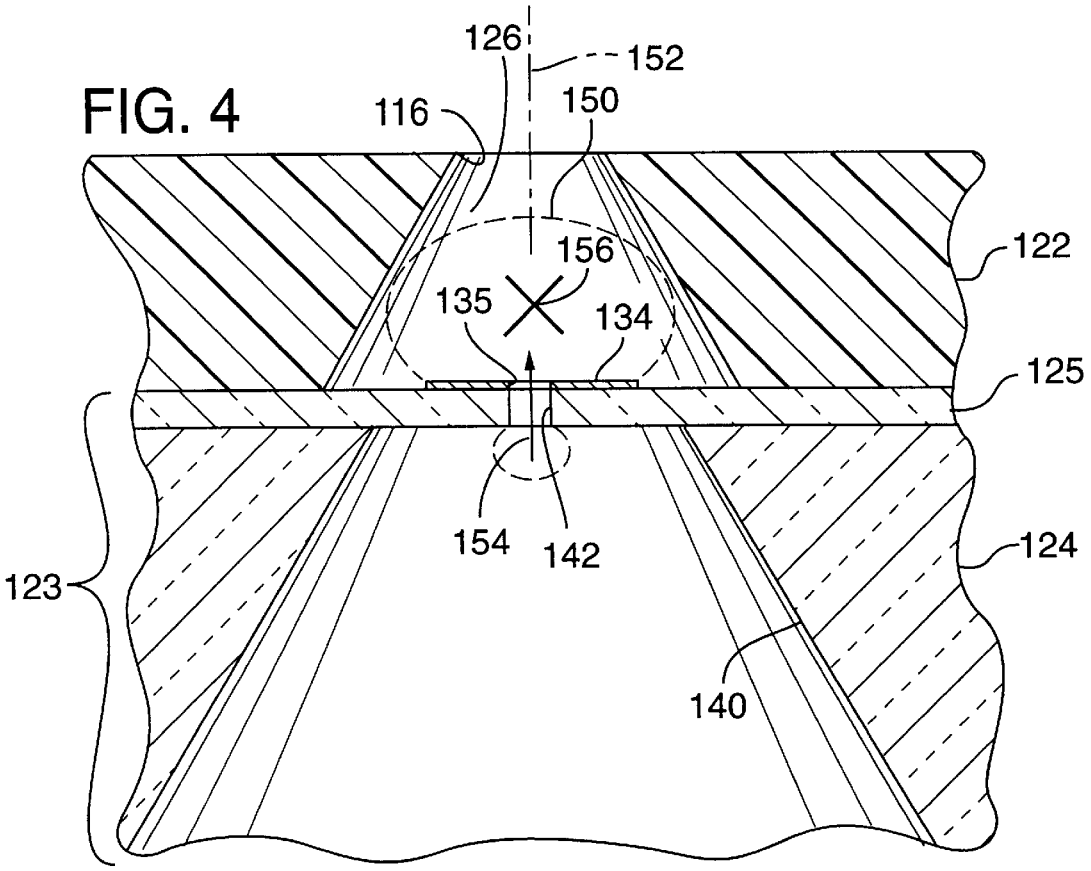
FIG. 4 is a cross-sectional view, similar to FIG. 2, but showing an alternative embodiment of the present invention.
Figure 5:
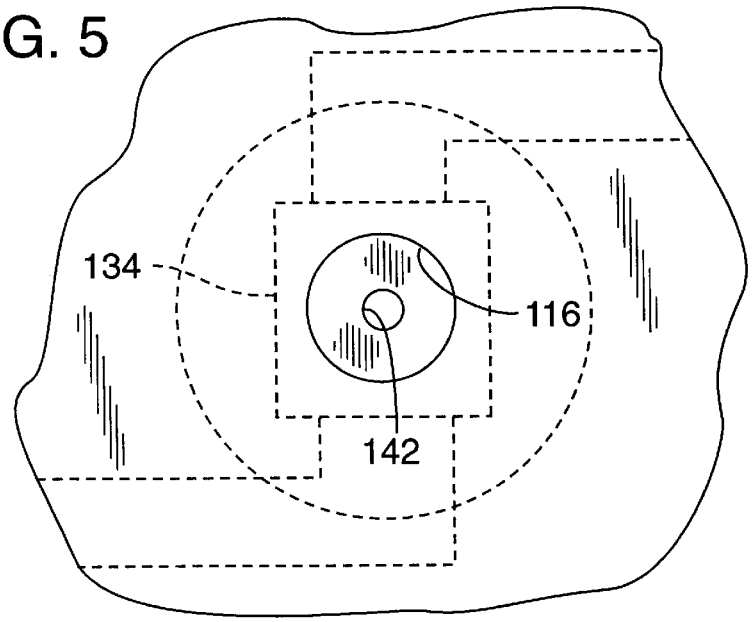
FIG. 5 is a top view of the embodiment of FIG. 4.

The embodiment depicted in FIGS. 4 and 5 is much like that depicted in FIGS. 2 and 3 inasmuch as this latter embodiment includes an orifice plate 122 that is attached to a substrate 123 that comprises a base 124 and support layer 125 as described with respect to similarly named components in the FIG. 2 embodiment.

In the embodiment of FIG. 4, the inlet 142 (here shown as a single inlet) is oriented in axial alignment with a central opening 135 that is formed in the resistor 134. As a result, the flow path 154 of the ink flowing from the channel 140 into the chamber 126 is substantially coaxial with the central axis 152 of the orifice 116. The expanding bubble 150 in this embodiment immediately occludes the inlet 142 upon expansion. The collapse point 156 of the bubble is lifted by the flow momentum of the refill ink to a location spaced from the surface of the resistor 134.

While a substantially square resistor 134 having a circular, central opening 135 is depicted, it will be appreciated that any of a variety of resistor shapes and opening shapes may be employed.

Figure 6:
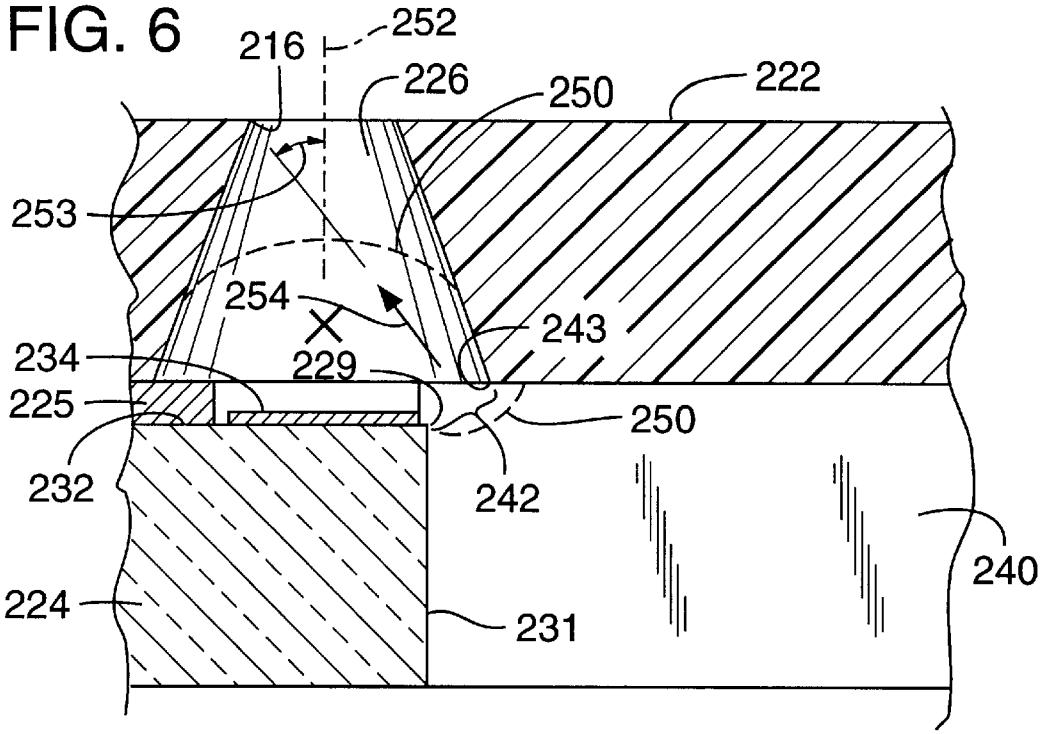
FIG. 6 is a cross-sectional view, similar to FIG. 2, but showing another alternative embodiment of the present invention.

The embodiment illustrated in FIG. 6 depicts an orifice plate 222 in which is formed a chamber 226 and orifice 216 in a manner as described with respect to the earlier embodiments. The substrate comprises a silicon base 224 and a relatively thick (for example, 8 $\mu$m) adhesive polymer layer 225 for securing the orifice plate 222 to the silicon base 224.

The ink channel 240 comprises an elongated slot etched into the silicon base 224 to a location very near (for example, 1 $\mu$m) one edge of the resistor 234. Accordingly, the inlet 242 is defined by the gap between the lower periphery 243 of the chamber 226 and the edge 229 defined by the upper surface 232 of the base and the end wall 231 of the etched channel 240. It will be appreciated that in plan view the inlet 242 in this embodiment is generally crescent shaped.

The cross-sectional area of the just-described gap or inlet is sized to conform to the preferred areal limitations mentioned above. The inlet 242 is also spaced very near the resistor 234. Consequently, the expansion of the bubble 250 upon firing causes the bubble to pass through the inlet 242 and occlude that inlet as ink is being ejected from the chamber 226 along central axis 252 of the associated orifice 216.

The flow path 254 of the refill ink into the chamber is, as in prior embodiments, directed away from the resistor and toward the orifice. In this embodiment, however, the flow path 254 of ink in the inlet is not quite parallel to the orifice central axis 252. Instead, the flow path 254 defines an acute angle (shown in FIG. 6 by reference numeral 253) with the central axis 252. In this arrangement, there remains enough flow momentum of the refill ink to lift the final collapse point "X" of the bubble from the surface of the resistor, thus providing the attendant protection from cavitation damage.

Figure 7:
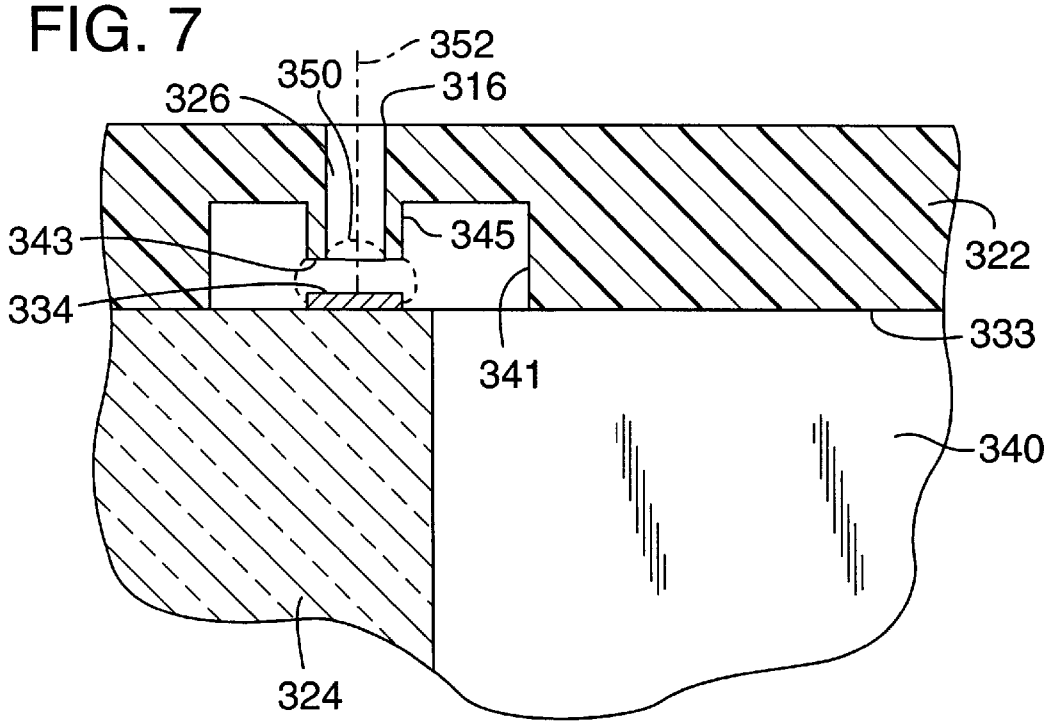
FIG. 7 is a cross-sectional view, similar to FIG. 2, but showing another preferred embodiment of the present invention.

FIG. 7 depicts a cross-section of another alternative embodiment of the present invention, whereby a silicon base 324 is etched in a manner similar to the embodiment of FIG. 6 to define a slotted channel 340 that terminates very near the resistor 334. In this embodiment, the orifice plate 322 comprises a KAPTON tape or similar polymer tape as described earlier, which, prior to being bonded to the base, is laser-ablated from its underside 333 to define the chamber 326 as described next.

In this (FIG. 7) embodiment, the orifice plate 322 or tape is transported into a laser processing chamber and laser-ablated in a pattern that is defined by one or more masks, using laser radiation such as generated by an Excimer laser of the $F_2$, ArF, KrCl, KrF, or XeCl type. The laser radiation is applied to define in the orifice plate 322 a generally annular recess 341 that serves as the extension of the ink channel 340 when the orifice plate 322 is mounted to the substrate base 324 as shown in FIG. 7.

The chamber 326 is formed to extend completely through the orifice plate 322 as shown in FIG. 7. Moreover, the laser radiation is masked and controlled so that the underside of the chamber is removed by an amount such that it is spaced from the resistor 334. As a result, the angular extension 341 of the channel and the chamber 326 define between them a tubular projection 345. It will be appreciated, therefore, that the space between this projection 345 and the resistor 334 defines the inlet through which refill ink flows into the chamber 326 from the channel extension 341. Moreover, the gap or inlet is occluded when the vapor bubble 350 generated by the heated resistor 334 expands to separate the liquid pathway between the angular channel 341 and the chamber 326.

A detailed description of a suitable process for the just-mentioned laser-ablation of orifice plate 322 is provided in U.S. Pat. No. 5,291,226, hereby incorporated by reference. It will be appreciated that although a substantially cylindrically shaped chamber 326 is depicted in the embodiment of FIG. 7, a frustrum-shaped chamber may also be produced using the laser-ablation process.

Figure 8:
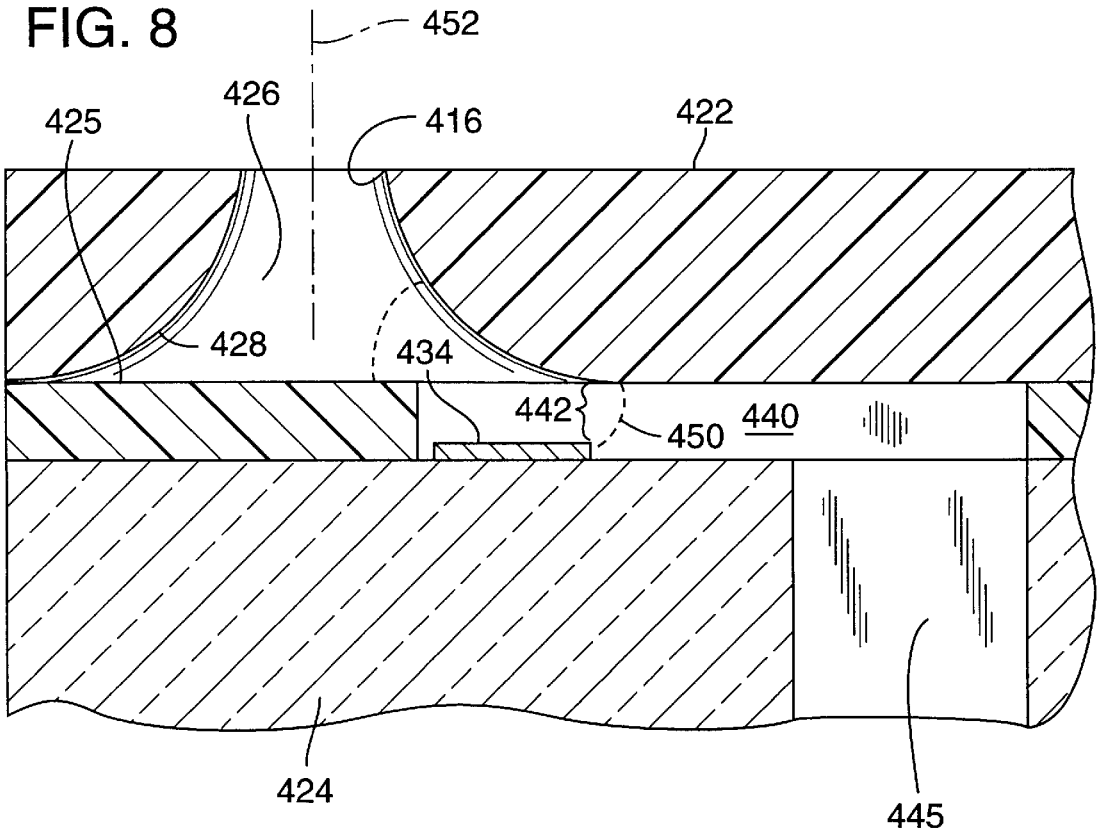
FIG. 8 is a cross-sectional view, similar to FIG. 2, but showing another embodiment of the present invention.

FIG. 8 depicts a cross-section of an alternative embodiment whereby the ink inlet 442 arises as a result of the positioning of an orifice plate 422 so that the central axis 452 of the orifice 416 is offset relative to the center of the resistor 434. In this embodiment, a silicon base 424 carries a thin-film resistor 434 that is connected, as described earlier, via conductive traces to the printer microprocessor for carrying voltage pulses that heat the resistor to expand a vapor bubble 450.

Between the substrate or base 424 and orifice plate 422, a barrier layer 425 is formed on the base 424. The barrier comprises a photosensitive polymer that is shaped by a photolithographic process to define on three sides of the resistor 434 a portion of the ink chamber 426. Where the barrier layer 425 is removed, there is defined an ink channel 440 for conveying ink from a distant slot 445 that is cut through the base 424 and is in fluid communication with the ink stored in the pen reservoir.

The orifice plate 422, which is preferably formed of electrodeposited nickel and is gold-plated, defines a smoothly tapered sidewall portion 428. The orifice plate 422 is laid over the resistors 434 so that the central axis 452 of the orifice 416 nearest the resistor 434 is displaced from the center of the resistor 434 to define the gap 442 as mentioned earlier. The gap, or inlet 442, is occluded by the expanding bubble 450 so that, as in other embodiments, the expanding bubble acts as a valve to temporarily close the inlet 442 for the advantages mentioned earlier.

Having described and illustrated the principles of the invention with reference to preferred embodiments, it should be apparent that the invention can be further modified in arrangement and detail without departing from such principles.

The invention claimed is:

1. An ink-jet printhead for ejecting ink droplets, comprising:

a chamber member having a chamber defined therein, the chamber having an orifice through which ink is ejected from the chamber;

a heating member positioned within the chamber for selectively generating a vapor bubble within the chamber;

an ink inlet through which ink flows to the chamber, the ink inlet being arranged to be occluded by the vapor bubble;

wherein the inlet defines an inlet flow area across which ink flows into the chamber, and wherein the inlet flow area is contiguous with the chamber and wherein the inlet flow area provides an areal restriction to ink flow into the chamber; and wherein the heating member has a length and the inlet is spaced from the heating member by a distance which is no more than about 25% of the heating member length.

2. The printhead of claim 1 further comprising a channel formed in the chamber member, the channel being in fluid communication with the inlet and wherein the inlet is smaller than the channel so that ink flow through the inlet into the chamber is restricted relative to ink flow through the channel.

3. The printhead of claim 1 wherein the heating member has an area, and wherein the inlet flow area across which ink flows into the chamber is less than about 120% of the area of the heating member.

4. An ink-jet printhead for ejecting ink droplets, comprising:

a chamber member having a chamber defined therein, the chamber having an orifice through which ink droplets are ejected from the chamber substantially parallel to a central axis of the orifice, the chamber member also having an inlet through which ink flows into the chamber along a flow path;

wherein an angle is defined between the flow path along which the ink flows and the central axis of the orifice;

the angle between the central axis and the flow path being less than about 90 degrees so that the flow of ink from the inlet into the chamber is generally directed toward the orifice;

wherein a heating member is positioned within the chamber for selectively generating a vapor bubble within the chamber; and wherein the heating member has a length and the inlet is spaced from the heating member by a distance which is no more than about 25% of the heating member length.

5. The printhead of claim 4 wherein the chamber member includes a substrate part to which a heating member is attached and through which the inlet is formed.

6. The printhead of claim 5 wherein the central axis and the flow path are substantially parallel.

7. The printhead of claim 5 wherein the substrate further comprises a channel formed therein, the channel being in fluid communication with the inlet for conducting ink to the inlet, the inlet being contiguous with the chamber and sized to be smaller than the channel so that ink flow through the inlet into the chamber is restricted relative to ink flow through the channel.

8. The ink-jet printhead of claim 5 wherein the inlet extends through the heating member.

9. A method of ejecting ink droplets from a printhead, wherein the printhead includes a heating member disposed within a chamber defined in the printhead, the heating member having a length, the chamber containing ink and having an orifice through which ink droplets are ejected from the chamber along a central axis, and an inlet through which ink flows into the chamber, and wherein a vapor bubble is created in the ink in the chamber when the heating member is heated by an amount sufficient to eject an ink droplet from the chamber, the method comprising the steps of:

configuring the chamber so that the inlet is occluded by the bubble;

locating the inlet adjacent to the heating member so that the bubble protrudes through the inlet to occlude the inlet; and wherein the heating member is arranged in the chamber whereby the central axis of the chamber is generally normal to the length of the heating member.

10. The method of claim 9 including the step of defining a channel in the printhead so that the channel is in fluid communication with the inlet for conducting ink to the inlet, the inlet being sized to be smaller than the channel so that ink flow through the inlet is restricted relative to ink flow through the channel.

11. The method of claim 9 including the step of orienting the inlet so that the flow of ink through the inlet is directed toward the orifice.

12. The method of claim 11 wherein the orienting step comprises the step of defining the inlet so that ink flows into the chamber along a flow path that is less than 90 degrees displaced from the central axis.

13. A method of controlling the ejection of ink droplets from a chamber of an ink jet printhead, comprising the steps of:

providing the chamber with an orifice through which an ink droplet may be elected from the chamber;

providing an inlet through which ink flows into the chamber;

expanding a vapor bubble in the chamber by an amount sufficient to eject an ink droplet from the chamber and substantially simultaneously to occlude the inlet with the bubble.

14. The method of claim 13 including the step of refilling the chamber after the ink droplet is expanded with ink that flows into the chamber along a flow path that is directed generally away from the heating member and toward the orifice.

* * * * *